US011335145B2

(12) United States Patent
Miller et al.

(10) Patent No.: US 11,335,145 B2
(45) Date of Patent: May 17, 2022

(54) ACCESS SYSTEM WITH AT LEAST ONE GATE

(71) Applicant: Scheidt & Bachmann GmbH, Mönchengladbach (DE)

(72) Inventors: Norbert Miller, Mönchengladbach (DE); Maximilian Rüßmann, Aachen (DE)

(73) Assignee: Scheidt & Bachmann GmbH, Mönchengladbach (DE)

( * ) Notice: Subject to any disclaimer, the term of this patent is extended or adjusted under 35 U.S.C. 154(b) by 0 days.

(21) Appl. No.: 17/237,811

(22) Filed: Apr. 22, 2021

(65) Prior Publication Data

US 2021/0358237 A1 Nov. 18, 2021

(30) Foreign Application Priority Data

May 15, 2020 (DE) ..... 10 2020 113 244.1

(51) Int. Cl.
*G07C 9/00* (2020.01)
*G07C 9/27* (2020.01)

(52) U.S. Cl.
CPC ..... *G07C 9/00309* (2013.01); *G07C 9/00571* (2013.01); *G07C 9/27* (2020.01)

(58) Field of Classification Search
CPC ... G07C 9/00309; G07C 9/27; G07C 9/00571
See application file for complete search history.

(56) References Cited

U.S. PATENT DOCUMENTS

| | | | | |
|---|---|---|---|---|
| 5,648,767 | A | 7/1997 | O'Connor et al. | |
| 10,163,178 | B1 * | 12/2018 | Sprogis | H04W 4/02 |
| 2006/0145893 | A1 | 7/2006 | Hassett | |
| 2010/0167662 | A1 * | 7/2010 | Kluge | H04W 24/06 455/67.16 |
| 2017/0046889 | A1 | 2/2017 | Clemente et al. | |
| 2018/0144563 | A1 * | 5/2018 | Reymann | E06B 11/02 |
| 2020/0018818 | A1 | 1/2020 | Jager et al. | |

(Continued)

FOREIGN PATENT DOCUMENTS

DE 695 28 807 T2 9/2003

OTHER PUBLICATIONS

European Patent Office, European Search Report, Application No. 21168375.0, dated Oct. 5, 2021, 8 pages (in German).

(Continued)

*Primary Examiner* — Nabil H Syed
(74) *Attorney, Agent, or Firm* — Sunstein LLP

(57) ABSTRACT

The application relates to an access system (100, 200, 500, 600, 700) comprising at least one first gate (102, 602.1, 602.2, 702.1, 702.2) configured to enable an access from a first area (104) to a second area (106), the first gate (102, 602.1, 602.2, 702.1, 702.2) comprising at least one first array antenna arrangement (108, 208, 308, 308.1, 308.2, 508, 608.1, 608.2, 708.1, 708.2) configured to process at least one information signal (234, 446, 564.1, 564.2, 564.3, 562, 662.1, 662.2, 734) including at least one modulated signal part (458) and at least one unmodulated signal part (456), wherein the first array antenna arrangement (108, 208, 308, 308.1, 308.2, 508, 608.1, 608.2, 708.1, 708.2) comprises a plurality of gate antennas (110, 210, 510) arranged adjacent to each other.

20 Claims, 8 Drawing Sheets

(56) References Cited

U.S. PATENT DOCUMENTS

| | | | | |
|---|---|---|---|---|
| 2020/0088863 | A1* | 3/2020 | Ootaka | G01S 13/84 |
| 2020/0118372 | A1 | 4/2020 | Stitt et al. | |
| 2021/0312146 | A1* | 10/2021 | Khojastepour | G06K 7/10029 |

OTHER PUBLICATIONS

Mikko Savolainen, *Bluetooth 5.1 Introduces Sub Meter Positioning*, XP055843909, https://www.silabs.com/documents/public/presentations/ew-2019-bluetooth-direction-finding-bluetooth-5-1-feature.pdf, 12 pages.

German Patent Office, Office Action, Application No. 10 2020 113 244.1, dated Dec. 16, 2020, 10 pages (in German).

Hao Zhou et al., *Beam Acquisition and Training in Millimeter Wave Networks with Narrowband Pilots*, IEEE Journal on Selected Areas in Communications, vol. 37, No. 12, pp. 2759-2771, Dec. 2019, doi: 10.1109/JSAC.2019.2947856.

* cited by examiner

ACCESS SYSTEM WITH AT LEAST ONE GATE

This application claims the benefit of German patent application No. 10 2020 113 244.1, filed May 15, 2020, the full disclosure of which is incorporated herein by reference.

TECHNICAL FIELD

The application relates to an access system comprising at least a first gate configured to enable an access from a first area to a second area. Furthermore, the application relates to a method for operating an access system, an access application, a method for operating an access application, and a mobile terminal.

BACKGROUND ART

Access systems for controlling an access from a first area to a second area are known from the prior art. For example, the access (and entry, respectively) from an uncontrolled area to a controlled area and/or the access (and exit, respectively) from a controlled area to an uncontrolled area may be controlled using an access system.

An access system comprises at least one gate respectively an access barrier. A gate is configured to selectively block and selectively enable an access from a first area to a second area. In particular, a gate can ensure that only authorized users can pass through the gate, for example, in order to enter the controlled area and/or to exit from the controlled area. Access systems are used, for example, in transit systems, but also in other applications where an access of users is to be controlled.

Known gates are configured to check an access authorization of a user before a release of a passing of the gate. For example, access systems are known in which a user's ticket medium is validated before a release. A user may have a ticket medium with an access code (and authentication datum, respectively) readable by an interface device of the gate (e.g., magnetic stripe code, bar code, QR code, RF identifier, other readable user or mobile terminal identifier, etc.).

In the initial state, the gate is usually locked, meaning that a barrier element of the gate physically prevents a user from passing through the gate. In other cases, the gate may be open in the initial state and may close only when a user without a valid access authorization attempts to pass through the gate.—Without limiting the generality, it is assumed below that the gate is locked in the initial state and is intended to open upon a positive validation of an access authorization of the user for going through of the user.

A (local) control module of the gate and/or a backend system communicatively coupled to the gate can validate the read access code and the read authentication datum, respectively, and release an access from a first to a second area, i.e., a passage through a gate, if the result is positive. If the result is negative and the user is not authorized, the gate remains blocked.

In order to improve, in particular, the user-friendliness of access systems, it is known from the prior art to use mobile terminals, such as smartphones. In particular, an access application in the form of an app can be installed on the mobile terminal of a user. The access application is configured for communication with a communication module associated with the gate, in particular, in order to provide the gate with an authentication datum of the mobile terminal and of the corresponding user, respectively, via a wireless communication channel for the verification described above. This is done, in particular, automatically, i.e., without requiring any user action.

However, it is problematic that the position of a mobile terminal in front of a gate can only be determined with low accuracy. In particular, in a gate arrangement and gate array, respectively, with a plurality of gates, it is difficult to open the correct gate at the correct time (i.e., not too early and not too late) to allow the corresponding user to go through the gate.

Although it is known to install and use additional sensors in the first area, i.e., the access area, such as cameras, beacons, etc., to determine the position data of the mobile terminal and user, respectively. In addition to the disadvantage of an increased installation effort of such sensor technology, satisfactory results cannot be achieved in practice even in such access systems. In particular, delays and corresponding reductions in throughput or unintentionally opened gates occur when there is a high volume of users. The unintentionally opened gates can lead to unauthorized users being able to pass through the gate.

Therefore, the object of the application is to provide an access system that enables an increase in throughput with, in particular, reduced installation effort and, at the same time, a reduction in the risk of a passing by unauthorized users.

SUMMARY OF THE INVENTION

The access system of an embodiment of the invention comprises at least a first gate configured to enable an access from a first area to a second area. The first gate comprises at least a first array antenna arrangement configured to process at least one information signal containing at least one modulated signal part and at least one unmodulated signal part. The first array antenna arrangement comprises a plurality of gate antennas arranged adjacent to each other.

By providing, in contrast to the prior art, according to the application, an access system with at least one gate that comprises at least one array antenna arrangement configured to process an information signal containing at least one modulated signal part and at least one unmodulated signal part, an increase in throughput is made possible for the gate, in particular, with reduced installation effort. Installations of further sensors in the gate area can be avoided. At the same time, the risk of an unauthorized user passing through the gate can be reduced.

According to the application, the processing of an information signal by at least one array antenna arrangement means that the at least one array antenna arrangement can, in particular, receive and/or emit the information signal.

In particular, an array antenna arrangement enables the evaluation of at least one unmodulated signal part of an information signal in such a way that position data of a mobile terminal interacting with the array antenna arrangement by means of the at least one information signal can be determined with a particularly high accuracy. Thus, according to the application, it has been recognized that using the (specific) information signal and the (specific) array antenna arrangement, a position determination of a mobile terminal is possible with an accuracy in the decimeter range, in particular, between 0.3 m to 0.5 m. This in turn allows the correct gate to be released at the correct time point.

The access system, according to the application, comprises at least a first gate used to control an access from a first area to a second area. Preferably, the access system may comprise a plurality of gates, in particular, a gate arrangement comprising a plurality of gates.

The access system, according to the application, may be used to control an access into and/or an exit from at least one second area. Exemplary and non-exhaustive fields of application of an access system, according to the application, are buildings and/or building areas, such as office buildings, airports, train stations, train platforms, boarding zones, residential buildings, swimming baths, leisure parks and the like, and vehicles, such as rail vehicles, buses or airplanes.

A gate is a passage barrier to and/or from a controlled area. Exemplary gates comprise swinging doors, retractable doors or telescopic doors or turnstiles as barrier elements. In addition, there are special cases of gates without barrier elements, which indicate the permission or prohibition of a passage exclusively optically and/or acoustically.

The at least one gate is operable in at least one direction. It shall be understood that a gate can also be operated in at least two different directional operating modes. In the present context, a directional operating mode means the direction (entry direction, exit direction or entry and exit direction) in which a gate can be passed.

According to the application, the first gate comprises an array antenna arrangement. An array antenna arrangement (also called phased array antenna) comprises a plurality of gate antennas arranged adjacent to each other. The at least two gate antennas of an array antenna arrangement are electrically interconnected. The gate antennas have, in particular, a defined structure and/or a defined position with respect to each other, in particular, a defined distance from each other. The structure and the position can be selected depending at least on the frequency of the information signal to be processed. For example, the gate antennas can be arranged parallel to each other, in each case with the same spacing. In particular, the gate antennas are identically shaped.

A gate antenna is designed for emitting and/or receiving an information signal. An information signal according to the application is, in particular, a data packet signal with a modulated signal part and an unmodulated signal part of an electromagnetic signal. The modulated signal part contains data content (e.g., preamble, access-address, PDU, CRC) in a conventional manner. Additionally, an information signal, according to the application, contains an unmodulated signal part (e.g., 1 to 300 μs unmodulated signal duration, preferably 16 to 160 μs). The unmodulated signal part provides a constant frequency that can be evaluated for position determination.

The unmodulated signal part (section) is characterized by the fact that it is not a carrier of data content. In other words, the unmodulated signal part is not frequency modulated and not amplitude modulated (and not phase modulated). However, the unmodulated signal part can be demodulated in a signaling manner. The unmodulated signal part is divided into two paths in a so-called I&Q process, one path of the demodulation is carried out with the original phase position (also called in phase) and results in the I data, the second path is carried out with the reference frequency shifted by 90° and results in the Q data (also called quadrature).

Preferably, the information signal is a near-field information signal, e.g. based on one of the technologies, such as Bluetooth, Wibree, WiMAX, ZigBee, WLAN or NFC. Preferably, the information signal can be a Bluetooth information signal, particularly preferably, a Bluetooth information signal of version 5.X (or a higher version).

The information signal can preferably be an advertising signal. According to a preferred embodiment, the advertising signal can be a Bluetooth Low Energy (BLE) signal (at least version 5.X). In particular, a BLE advertising signal can be emitted, received and evaluated by almost any mobile terminal, in particular, with a commercially available operating system (e.g. Apple iOS, Google Android, Microsoft Windows Mobile, Microsoft Mobile Phone, Blackberry OS, Symbian OS, Firefox OS, Tizen, Aliyun OS).

In one case, the access system may be formed by a single gate (or by a gate array having a plurality of gates).

According to a preferred embodiment of the access system according to the application, the first array antenna arrangement may comprise at least one gate receiving device (electrically) coupled to the gate antennas. In other words, the first array antenna arrangement serves for receiving information signals.

Each gate antenna can be a receiving gate antenna, and, in particular, be tuned for receiving information signals. Each of the gate antennas is electrically connected to the gate receiving device, in particular, in order to make the respectively received information signals available to the gate receiving device as antenna signals. The gate receiving device is configured to further process the antenna signals.

In particular, the gate receiving device can be configured to determine position data of a mobile terminal emitting the information signal. This can be carried out based on the unmodulated signal part of a received information signal. Position data are (system-wide unified) coordinates which, in particular, unambiguously define the position (usually a position range due to measurement tolerances) of the emitter of the information signal in relation to the receiver (i.e., in this case an array antenna arrangement). In one embodiment (described in more detail later) in which an information signal is emitted by an array antenna arrangement, position data are, in particular, (system-wide unique) coordinates which, in particular, unambiguously define the position (usually a position range due to measurement tolerances) of the receiver of the information signal in relation to the emitter (i.e., in this case the array antenna arrangement).

For example, a polar coordinate system may be used in which the array antenna arrangement, the geometric center of the array antenna arrangement, or a specified other geometric point of the gate forms the origin of the polar coordinate system. The distance from the origin may be denoted by radius (r) and a radial coordinate, respectively, and an angular datum and angle, respectively, may be denoted by an angular coordinate (φ). It shall be understood that other coordinate systems, such as a Cartesian coordinate system, may be used.

According to a further embodiment of the access system according to the application, each of the gate antennas may be configured to provide an antenna signal. This may be based on the unmodulated signal part of the received information signal.

It shall be understood that the modulated signal provided can also be provided as an antenna signal in order to be able to further process the data content (payload) contained therein. Essentially, the antenna signal that represents the unmodulated signal part is used to determine the position data. For example, the antenna signal may be a portion of an overall antenna signal. The gate receiving device may comprise at least one demodulation module configured to demodulate the provided antenna signals.

Preferably, according to a further embodiment of the access system according to the application, the demodulation module may be configured to demodulate the provided antenna signals in such a way that for each of the antenna signals an amplitude datum and a phase datum of the unmodulated signal section is determined. In particular, the demodulation module may be an I&Q demodulation module configured to perform I&Q demodulation (in-phase demodulation and quadrature demodulation). While in a simple demodulation usually only the amplitude datum, i.e. the real part of a complex signal, is determined, it is proposed according to the present embodiment to additionally determine also the phase datum, i.e. the imaginary part of the complex signal. In particular, using the phase datum and the phase information, respectively, the (current) position data of the emitter that has emitted the information signal can be determined exactly. By means of an amplitude datum, in particular, a differentiation of different signal waves can take place.

According to a particularly preferred embodiment of the access system according to the application, the gate receiving device can comprise at least one position determination module configured to determine (in particular, calculate) a first angular datum. This can be done based on the determined amplitude data and the determined phase data of the antenna signals.

In particular, the demodulated data, i.e. the amplitude datum and the phase datum of each antenna signal (in particular, in digital form), can be provided to the position determination module. The position determination module may, in particular, be configured to further process the provided data (according to at least one predetermined calculation rule). The position determination module may preferably be configured to at least partially determine (in particular, calculate) the position data, at least based on the determined first angular datum.

An angular datum is, in particular, an angular indication to a (predeterminable) reference line which lies in a horizontal plane. In particular, the reference line may be the polar axis (lying in a substantially horizontal plane) in a polar coordinate system, and an angular datum of a particular point may be the angle $\varphi$ between the polar axis and a radius vector pointing from the origin of the polar coordinate system to the particular point.

In principle, the distance (in particular, the radius r) between the emitter and the array antenna arrangement (in particular, the gate antennas) can be determined in any way. According to an embodiment of the access system according to the application, the position determination module may be configured to determine the position data based on the determined first angular datum and the RSSI (Received Signal Strength Indicator) of the information signal received by the gate antennas. In particular, the RSSI represents an indicator of the received field strength of the received information signal. The RSSI can be used, in particular, to determine the distance (in particular, a distance range in which measurement tolerances are taken into account). Together with the first angular data, the position determination module can determine the position data (e.g. in the form $\{r, \varphi\}$) of the mobile terminal with high accuracy.

According to a preferred embodiment of the access system according to the application, a triangulation can be performed, as an alternative or in addition to the use of the RSSI, in order to determine the position data of the mobile terminal with particularly high accuracy. In particular, the gate receiving device may comprise at least one receiving device interface configured to obtain at least one further angular datum determined for the received information signal. The further angular datum may be provided by a further array antenna arrangement arranged adjacent to the first array antenna arrangement, wherein the distance and angle between said antenna arrangements may be known to the position determination module. Due to an identifier contained as data content in the information signal, it can be ensured that both evaluated information signals originate from the same emitter.

The position determination module may be configured to determine the position data based on the determined first angular datum and the provided further angular datum. The first angular datum and the further angular datum indicate, in particular, the angle to the emitter (with respect to the respective polar axis (which may be, in particular, parallel to each other)) from the respective origin, i.e. the respective array antenna arrangement. By determining the intersection point (in particular, an intersection range that takes into account the measurement tolerance in the respective angular datum determination), the position data of the emitter respectively the mobile terminal, are determined. In particular, a determination can be made with an accuracy of 0.3 m to 0.5 m.

It shall be understood that in other variants of the application in which a different coordinate system is used, an angular datum can also be expressed by other coordinate data. In particular, it is known to the person skilled in the art how a conversion from one coordinate system to another coordinate system can be carried out.

As has already been described, according to a further embodiment, the access system may comprise a gate arrangement. The gate arrangement may comprise the (described) first gate and at least one further gate. In particular, a plurality of gates may be arranged side by side (in a defined manner known in the system). The further gate (in particular, each further gate) may comprise a further array antenna arrangement comprising a plurality of gate antennas arranged adjacent to each other.

The further array antenna arrangement may comprise at least one gate receiving device coupled to the gate antennas. A further array antenna arrangement may be formed, in particular, corresponding to the first array antenna arrangement. The gate receiving device of the further gate may, in particular, comprise at least one receiving device interface communicatively connectable to the receiving device interface of the first gate. In particular, the respective receiving device interfaces may be arranged to provide and/or receive an angular datum. Preferably, all gate receiving devices can be communicatively coupled to each other.

It shall be understood that a gate receiving device may comprise a plurality of distributedly arranged modules and/or that a module, such as a demodulation module and/or a position determination module, may be formed by two or more (distributedly arranged) elements. It shall be further understood that a module, such as a position determination module, may be shared by a plurality of gate receiving devices.

Preferably, in each gate of a gate arrangement, the respective array antenna arrangement can be mounted at the (almost) same position. Furthermore, preferably the respective distance and/or the respective angle, i.e. the alignment to each other, between all adjacent gates of a gate arrangement can be (almost) the same. In other words, the respective distance and the respective angle between all adjacent array antenna arrangements is (nearly) identical. By this, a cluster of array antenna arrangements coupled to each other can be formed.

Such an interconnection to form a cluster of array (group) antenna arrangements enables an even more precise location of a mobile terminal. In addition, "blind spots", in particular, in the first area, can at least be reduced. Furthermore, anomalies (such as an attempt by an unauthorized person to "cheat" his way through the gate) can be detected by evaluating the received information signals.

In particular, as an alternative to the embodiment with the gate receiving device, according to a further preferred embodiment of the access system according to the application, it may be provided that the first array antenna arrangement comprises at least one gate emitting device coupled to the gate antennas. The gate emitting device may be configured to control an emission of a first array information signal by the gate antennas. The first array (group) information signal may include a plurality of individual information signals respectively emitted by the gate antennas. In particular, an individual information signal is formed similarly to a previously described information signal and includes a modulated signal part and an unmodulated signal part. A plurality of individual information signals of an array antenna arrangement form an array in the form of an array antenna signal of the corresponding array antenna arrangement.

In particular, it has been recognized, according to the application, that position data of a mobile terminal can also be determined by the access system comprising an array antenna arrangement emitting an array information signal controlled by a gate emitting device. While in the embodiment in which the array antenna arrangement comprises a gate receiving device, a so-called evaluation of the "angle of arrival" ("AoA") is carried out, in the case of the array antenna arrangement comprising a gate emitting device, a so-called evaluation of the "angle of departure" ("AoD") is carried out. Both evaluations enable to determine the position data of the mobile terminal with a high degree of accuracy in relation to the respective at least one array antenna arrangement.

According to a preferred embodiment of the access system according to the application, the gate emitting device may be configured to control the emission of the first array information signal in such a way that the respective unmodulated signal parts of the individual information signals of the first array information signal each have a specific phase relationship to one another. Based on the respective phase relationships of the at least two individual information signals of the first array information signal, a determination of the position data of a mobile terminal receiving the array information signal can be made.

Furthermore, according to a further embodiment of the access system according to the application, the access system may comprise at least one terminal receiving device arranged in a mobile terminal (whose position data is to be determined), which is coupled to an antenna of the mobile terminal. In particular, a (software) access application installable on the mobile terminal may be provided as a terminal receiving device.

The terminal receiving device may comprise at least one demodulation module configured to demodulate first antenna signals resulting from the first array information signal received by the antenna of the mobile terminal. In particular, the demodulation module may be an I&Q demodulation module (as previously described). In particular, the demodulation module may determine an amplitude datum and a phase datum for each provided (digital) antenna signal, respectively.

According to a preferred embodiment of the access system according to the application, the terminal receiving device may comprise at least one position determination module configured to determine position data of the mobile terminal (relative to the emitting array antenna arrangement). This may be based on the demodulated first antenna signals, in particular, the phase datum determined for each first antenna signal and the amplitude datum determined for each first antenna signal. The position determination module may determine a first angular datum based on the demodulated antenna signals. In particular, the position determination module may determine a first angular datum based on the amplitude data and phase data (in particular, in an analogous manner to the operation of the position determination module of the gate receiving device, so that reference is made thereto to avoid repetitions). In the case of a polar coordinate system, the origin may, in particular, be the antenna of the mobile terminal (and the mobile terminal itself, respectively).

Preferably, according to a further embodiment of the access system according to the application, the position determination module may be configured to determine (in particular, calculate) position data of the mobile terminal based on the demodulated first antenna signals and the RSSI of the first information signal received by the antenna of the mobile terminal. In particular, the position determination module may determine as position data an angle and a radius, based on the RSSI and a first angular datum (as has been described, in particular, previously).

Alternatively or additionally, the position determination module may be configured to determine the position data of the mobile terminal based on the demodulated first antenna signals and on demodulated second antenna signals of a further emitted array information signal that was emitted by a further array antenna arrangement arranged adjacent to the first array antenna arrangement. In a manner analogous to the above, an intersection point can be determined, in particular, from two angular data, in particular, an intersection point range. The intersection point range represents the (current) position of the mobile terminal in relation to the at least two array antenna arrangements.

In particular, the determined position data can be transmitted to the gate by the mobile terminal via a communication link, in particular, to a control module of the gate.

According to a further embodiment of the access system according to the application, a gate (the first gate and/or (each) further gate) may comprise a front side and a back side. The front side may face the (current) direction of passage. At least the plurality of gate antennas of an array antenna arrangement may be arranged at the front side, in particular, directly behind a front side of a gate housing forming the front side. In this way, the gate antennas of an array antenna arrangement are arranged optimized with respect to a first area to be monitored.

When a gate is bi-directionally operable, an array antenna arrangement may be installed at both the (current) front side and the (current) back side. For example, a plurality of gate antennas may be arranged at each of the front side and back side, each of which may be coupled to a single gate receiving device or a single gate emitting device. In particular, the coupling of the respective gate antennas can take place depending on the currently set directional operating mode.

According to a further embodiment of the access system according to the application, the gate (the first gate and/or (each) further gate) may have a bottom side. In particular, the bottom side lies in the same plane as the ground surface of the first and second area.

At least the plurality of gate antennas of the first array antenna arrangement can be arranged at a height above the bottom side (i.e. in particular, to a ground surface of the first and second area) between 0.3 m and 1.3 m, in particular, between 0.6 m and 1.1 m. A corresponding height has been shown to be particularly preferred, since it lies in the area in which a mobile terminal carried by a user is regularly located. For example, a mobile terminal may be located in a trouser pocket or a handbag of a user. By arranging the gate antennas in the aforementioned height range, they can be aligned particularly well with the mobile terminals and thus good evaluation results can be achieved.

Preferably, the plurality of gate antennas may be mounted at the (nearly) same height in each gate.

According to a further embodiment of the access system according to the application, a front panel forming the front side may be formed of a material (e.g., tinned copper foil, plastic, glass, plasterboard) that attenuates and/or filters electromagnetic signals, at least in the area of the plurality of gate antennas. In the case of a bi-directionally operable gate, the back side may be formed similarly.

In particular, the material can be formed in such a way that (almost) only information signals with a specific frequency (for example, corresponding to the carrier system used (e.g., Bluetooth, WLAN, etc.) may pass, while signals with a different frequency are blocked.

In addition, according to a further embodiment of the access system according to the application, at least one gate may comprise a (local) control module. For example, each gate may comprise a local control module. It may also be provided that a gate arrangement having a plurality of gates may comprise a single (local) control module for controlling the plurality of gates.

The control module may be configured to control an access through the gate based on the determined position data of a mobile terminal. In particular, the control module may be configured to enable a passage through the gate for a user of the mobile terminal at least based on the determined position data of the mobile terminal. The throughput through the at least one gate may be increased.

In a preferred embodiment of the access system according to the application, the control module may be configured to control an access through the gate, additionally based on at least one of the data from the group comprising:

- an authentication datum associated with the mobile terminal,
- a camera datum,
- a near-field sensor datum,
- a far-field sensor datum.

In particular, a release of a gate for a user of the mobile terminal may be based on the determined position data and an authentication datum associated with the mobile terminal. An authentication datum contains at least one piece of information (e.g., ticket information, user ID, etc.) indicating that a user is authorized to pass through the gate. For example, the authentication datum may be stored in the mobile terminal. Preferably, the authentication datum may be transmitted to the gate by an information signal (in particular, by the modulated signal part). The authentication datum may be verified (in a conventional manner) by the local control module (and/or an authentication module of a backend system). If the authentication datum authorizes the user to pass, the gate can be released. Otherwise, the gate remains blocked.

Preferably, a periodic and, in particular, nearly continuous determination of the position data of a mobile terminal in relation to the at least one gate can be conducted. This makes it possible, in particular, to determine a (current) movement profile of the mobile terminal. In particular, this makes it possible to identify the gate towards which a user of the mobile terminal is heading and to release the gate when the user actually reaches the gate.

In particular, due to the almost continuous determination of the position data, the correct gate can be released for the corresponding user immediately before reaching said gate. The user can pass the gate (almost) without delay.

It shall be understood that a gate remains blocked if the verification indicates that the user is not authorized and/or the position data indicates that the user does not want to pass the gate (but just happens to pass the at least one gate). It shall be also understood that an authentication datum can be provided via another communication path (e.g., via a backend system).

Preferably, a control of the gate and, in particular, its blocking elements can be further improved by using further available data, such as camera data from one or more cameras (installed in the first area), further sensor data, such as data from further near-field communication devices, light barriers, etc. For example, this can further improve the position determination, for example, position data can be verified by further available data. For example, the at least one corresponding sensor can be communicatively connectable with the control module.

According to a preferred embodiment of the access system according to the application, the access system may comprise at least one backend system. A backend system may be formed by one or more (distributed) server(s). In particular, a backend system is arranged remotely from the at least one gate.

The backend system may comprise at least one communication module configured to communicate with a control module of a gate and/or with the at least one mobile terminal. It shall be understood that a plurality of (different) communication modules may be provided, in particular, to be able to use different transmission technologies. Preferably, a communication may be carried out via a remote communication network, such as a cellular network and/or a cable-based remote communication network.

In particular, the communication module may be configured to transmit to the control module at least one of the data from the group comprising:

- position data of the mobile terminal,
- an authentication datum associated with the mobile terminal,
- a camera datum,
- a near-field sensor datum,
- a far-field sensor datum.

In particular, for the embodiment in which the array antenna arrangement comprises a gate emitting device and the position determination is conducted by a terminal receiving device, it can be provided that the corresponding mobile terminal (in particular, the access application) is configured to transmit a data set containing at least one authentication datum and/or the determined position data. For example, a user ID assigned to the user (uniquely system-wide) and/or ticket information (described above) can be transmitted as the authentication datum.

For example, each registered user may have a user account stored in the backend system with user data (e.g., user ID, billing data, authorization data) from which it can be determined whether a user is authorized (or not) to pass through a particular gate.

The data set may additionally contain a gate identifier. Each gate of an access system may be assigned with a gate identifier (uniquely system-wide). For example, the gate identifier may be contained in a (preferably each) individual information signal in the modulated signal part emitted by the array antenna arrangement of the corresponding gate. A data set may contain further data, such as a time stamp.

As has already been described, a periodic and, in particular, almost continuous determination of the position data of the mobile terminal can preferably be performed. The access application of the mobile terminal may cause that the almost continuously determined position data (together with said authentication datum) is transmitted periodically, almost continuously, in the form of a plurality of data sets to the backend system.

A further aspect of the application is a method of operating an access system with at least one gate, wherein the gate comprises an array antenna arrangement comprising a plurality of gate antennas disposed adjacent to each other and a receiving device coupled to the gate antennas, the method comprising:

receiving, by the gate antennas, an information signal containing at least one modulated signal part and at least one unmodulated signal part, providing, by the gate antennas, antenna signals each based on the unmodulated signal part of the received information signal, and determining position data of a mobile terminal emitting the information signal at least based on the provided antenna signals, in particular, on the portion of the provided antenna signals that is based on the unmodulated signal part of the received information signal.

In particular, the method can be used to operate the access system described above, i.e., to operate at least one gate described above, which comprises, for example, an array antenna arrangement with a gate receiving device.

A still further aspect of the application is an access application, in particular, in the form of a software application executable by a processor of a mobile terminal, for installation on a mobile terminal. The access application comprises at least one receiving module configured to receive antenna signals based at least on the respective unmodulated signal parts of individual information signals of an array information signal received by an antenna of the mobile terminal. The array information signal was emitted by an array antenna arrangement of a gate having a plurality of gate antennas arranged adjacent to each other. The access application comprises at least one position determination module configured to determine position data of the mobile terminal receiving the array information signal at least based on the unmodulated signal part of the individual information signals of the array information signal.

The access application is, in particular, a software application installable on a mobile terminal. The access application may be required for passing through a gate and, for example, for a proper use of a service, such as a transport service.

In an access system, which may for example be a component of a transit system, it may initially be necessary for the user to register with this system before using a gate for the first time (for example, in order to use a transport service). Upon an successful registration, a user account for the registered user is created in the access system, in particular, the backend system of the access system (also referred to as the background system) by storing identification data in the backend system, such as a unique (user) identifier (ID) of the user, authentication data, e.g. a password, and billing data, e.g. credit card data or account details, address data or other data for billing. Collectively, this data is called user master data. In addition, the access application may be installed on the mobile terminal of the registered user in the form of a so-called app.

The access application in the form of a computer program, in particular, the instructions or program commands, may be stored in a computer program product, in particular, a program memory. For example, a program memory is a non-volatile memory such as a flash memory, a magnetic memory, an EEPROM memory (electrically erasable programmable read-only memory) and/or an optical memory. In addition, a mobile terminal may have a main memory, for example, a volatile or non-volatile memory, in particular a random access memory (RAM), such as a static RAM memory (SRAM), a dynamic RAM memory (DRAM), a ferroelectric RAM memory (FeRAM), and/or a magnetic RAM memory (MRAM). For example, the mobile terminal processor may store intermediate results or the like in the main memory.

A further aspect of the application is a method for operating an access application, in particular, an access application described above. The method comprises:

receiving antenna signals based on at least the respective unmodulated signal parts of individual information signals of an array information signal received by an antenna of the mobile terminal, wherein the array information signal was emitted by an array antenna arrangement of a gate having a plurality of gate antennas arranged adjacent to each other, and determining position data of the mobile terminal receiving the array information signal based at least on the unmodulated signal part of the individual information signals of the array information signal.

A still further aspect of the application is a mobile terminal comprising at least one access application installed on the mobile terminal and described above.

Exemplary and non-exhaustive mobile terminals include smartphones, tablet computers, mobile gaming consoles, laptops, netbooks, data glasses, smart watches, and similar wearables. Alternatively, a mobile terminal may be a dedicated ticketing device designed exclusively for an access application.

A previously described module, element, etc. may comprise at least partially hardware elements (e.g., processor, memory means, etc.) and/or at least partially software elements (e.g., executable code). It should further be noted that terms such as "first"; "second" etc. do not indicate an order, but are used, in particular, to distinguish between two elements (e.g., gate, area etc.).

The features of the access systems, methods, access applications and mobile terminals can be freely combined with each other. In particular, features of the description and/or the dependent claims can be independently inventive, even by completely or partially circumventing features of the independent claims, in sole position or freely combined with each other.

BRIEF DESCRIPTION OF THE DRAWINGS

In the drawing shows.

In the following, the same reference signs are used for the same elements.

DETAILED DESCRIPTION OF SPECIFIC EMBODIMENTS

Figure 1:
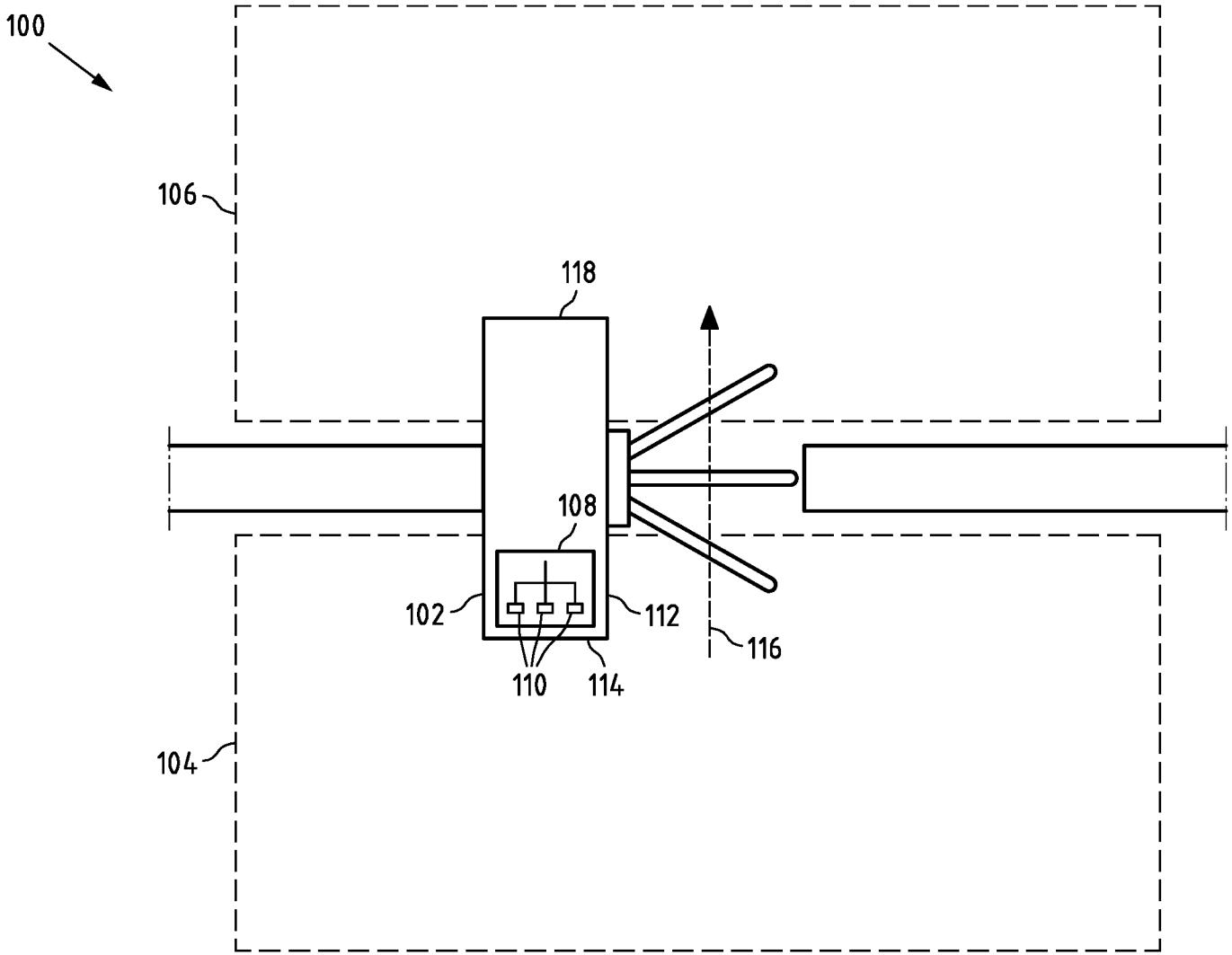
FIG. 1 a schematic view of an embodiment of an access system according to the present application, FIG. 2 a schematic view of a further embodiment of an access system according to the present application, FIG. 3*a* a schematic diagram for explaining an embodiment for determining position data of a mobile terminal, FIG. 3*b* a schematic diagram for explaining a further embodiment for determining position data of a mobile terminal, FIG. 4 a schematic representation of an embodiment of an information signal according to the present application, FIG. 5 a schematic view of a further embodiment of an access system according to the present application, FIG. 6 a schematic view of a further embodiment of an access system according to the present application, FIG. 7 a schematic view of a further embodiment of an access system according to the present application, FIG. 8 a diagram of an embodiment of a method according to the present application, and FIG. 9 a diagram of an embodiment of a method according to the present application.

FIG. 1 shows a schematic view of an embodiment of an access system 100 according to the present application. The access system 100 may be used, for example, in a transit system. The transit system comprises at least a first gate 102. The first gate 102 is configured to enable an access from a first area 104 to a second area 106. Here, the direction of passage through the gate 102 is indicated by the arrow 116. In other variants of the application, it may also be provided that a gate is operable in two directions.

In particular, the illustrated gate 102 is configured to provide an access or an entry from the uncontrolled area 104 to the controlled area 106 to authorized users and to provide an access or an exit from the controlled area 106 to the uncontrolled area 104.

For example, a user has a ticket medium (not shown) with an authentication datum, e.g., in the form of an access code (e.g., magnetic stripe code, bar code, QR code, RFID identifier, other readable user or mobile terminal identifier, etc.) readable by an interface device (not shown) of the gate 102.

In preferred variants of the application, an installed access application may be present on a mobile terminal of the user, wherein the application may be configured for a communication with a communication module of the gate, in particular, in order to provide to the gate via a wireless communication channel an authentication datum of the mobile terminal and of the corresponding user, respectively, for verification as described above, without requiring any user action.

The gate 102 and/or a remotely located computing device (e.g., of a backend system) may check the at least one authentication datum and allow access into the second (controlled) area 106, i.e., a passage through the gate 102, if the result is positive. If the result is negative and the user is not authorized, the gate 102 remains blocked.

As can be seen, according to the application, the gate 102 comprises at least a first array antenna arrangement 108. In particular, the first array antenna arrangement 108 is integrated in a gate housing 112 of the gate 102. The array antenna arrangement 108 is arranged at a front side 114 of the gate 102. In this case, the front side 114 faces the passage direction 116. Presently, no array antenna arrangement is arranged at the back side 118 of the gate 102. As has already been described, in a gate that is also operable in the other direction, an array antenna arrangement may also be arranged at the back side.

The first array antenna arrangement 108 comprises a plurality of gate antennas 110 (of the same configuration). As an example, three gate antennas 110 are illustrated herein. It shall be understood that only two or more than three gate antennas may be provided.

As can be seen, the gate antennas 108 are electrically connected with each other. In particular, the gate antennas 108 have a defined structure and defined position with respect to each other, in particular, a defined distance to each other. This may depend at least on the frequency of the information signal to be processed. For example, the gate antennas 108 may be arranged parallel to each other, each with the same spacing, as shown. It shall be understood that other arrangements are also possible, such as the arrangement along a half or quarter circle.

The first array antenna arrangement 108 is configured to process at least one information signal containing at least one modulated signal part and at least one unmodulated signal part. The processable information signal may preferably be a Bluetooth information signal (at least version 5.X). In this and the following examples, such a Bluetooth information signal is always assumed as an example. However, the following explanations can be applied to the other information signals described above.

In particular, the combination according to the application of a use of such an information signal with an array antenna arrangement 108 integrated in the gate 102 enables a determination of the position of a mobile terminal with respect to the array antenna arrangement 108 and the corresponding gate 102, respectively (with a particularly high accuracy). This will be explained in more detail below with reference to the further embodiments.

Figure 2:
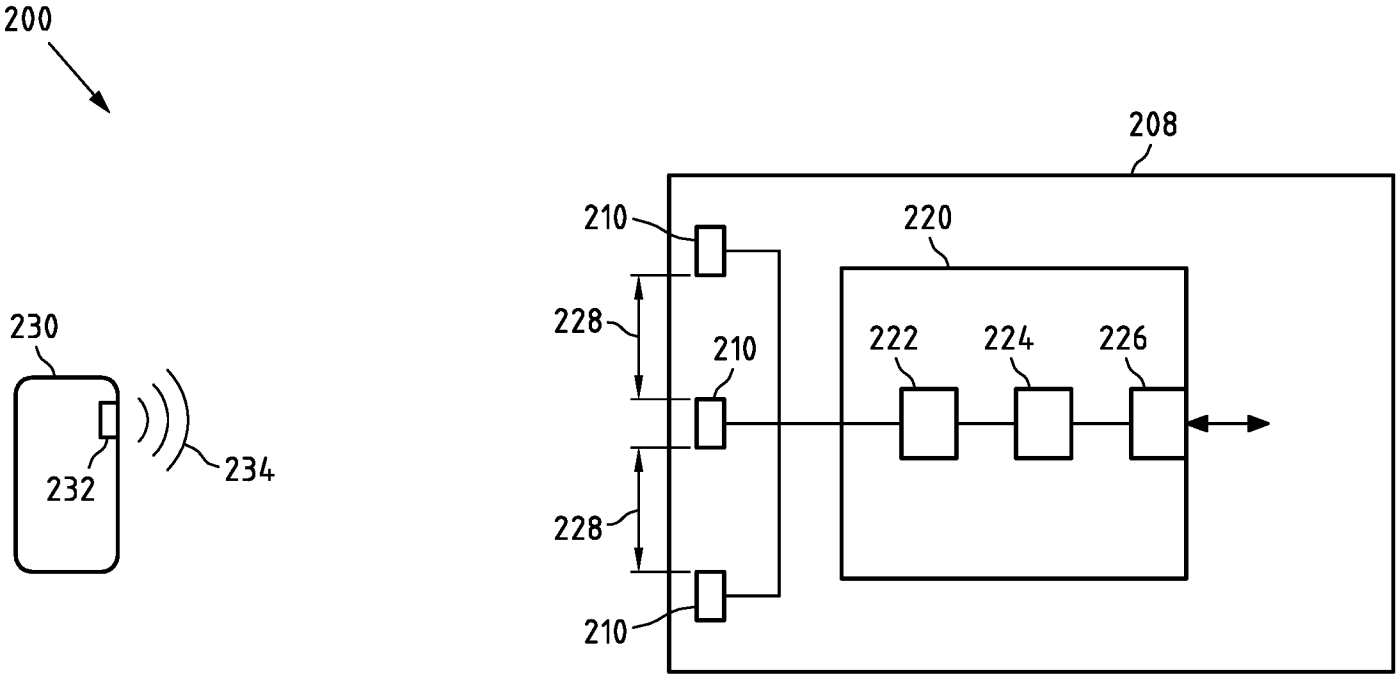

FIG. 2 shows a schematic view of a further embodiment of an access system 200, according to the present application. To avoid repetitions, essentially only the differences to the previous embodiment are described below, and otherwise reference is made to the previous explanations. It should further be noted that, for the sake of clarity, the gate has been omitted. In particular, the shown embodiment is based on the "Angle of Arrival" scheme.

The shown array antenna arrangement 208 comprises a plurality of gate antennas 210 arranged in parallel to each other. The same spacing 228 is provided between each immediately adjacent gate antenna 210. A gate receiving device 220 is electrically connected to the gate antennas 210.

In the present embodiment, the gate receiving device 220 comprises a demodulation module 222, a position determination module 224, and a receiving device interface 226. It shall be understood that further components may be provided, such as filters, amplifiers, A/D converters, etc.

Each gate antenna 210 may provide an antenna signal to the demodulation module 222 based on a received information signal. The demodulation module 222 may demodulate the respective antenna signal. In particular, the demodulation module 222 may be configured to determine an amplitude datum and a phase datum for each of the antenna signals. Preferably, an amplitude datum and a phase datum are determined for the respective unmodulated signal part of a received information signal.

It shall be understood that demodulation of the modulated signal part of the information signal can also be performed in order to decode and, in particular, evaluate the data content contained therein (e.g. user ID, authentication datum, time stamp and/or the like).

The determined data may be provided to the position determination module 224. In particular, the position determination module 224 is configured to determine a first angular datum based on the determined amplitude data and the determined phase data of the demodulated antenna signals. Based at least on the first angular datum, the current position data of the emitting mobile terminal 230 may then be determined, at least in part.

The mobile terminal 230 may comprise a communication module with an antenna 232 to emit (in particular, periodically and/or almost continuously) the information signal. The reference sign 234 indicates that the mobile terminal 230 emits the information signal in the present example.

For example, the emission may be controlled by an access application (not shown) installed on the mobile terminal 230. For example, an emission may be triggered by a trigger signal transmitted by a (not shown) transmitting device of the access system. For example, a beacon may be provided that transmits a trigger signal. The trigger signal may contain a code that—after being received by the mobile terminal 230—causes the information signal to be emitted when executed by the mobile terminal 230 (controlled by an activated access application). The access application may, for example, be activated by the user or by a wake-up signal from a further (not shown) transmitting device of the access system.

Figure 3B:
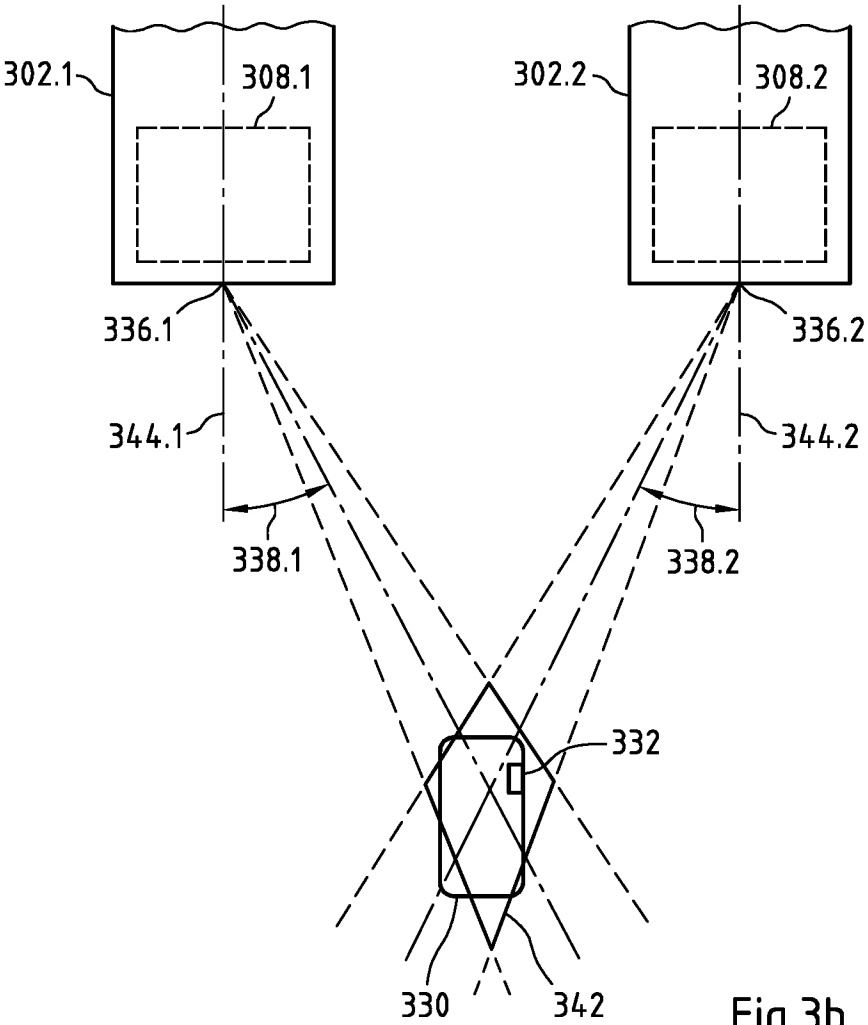
Figure 3A:
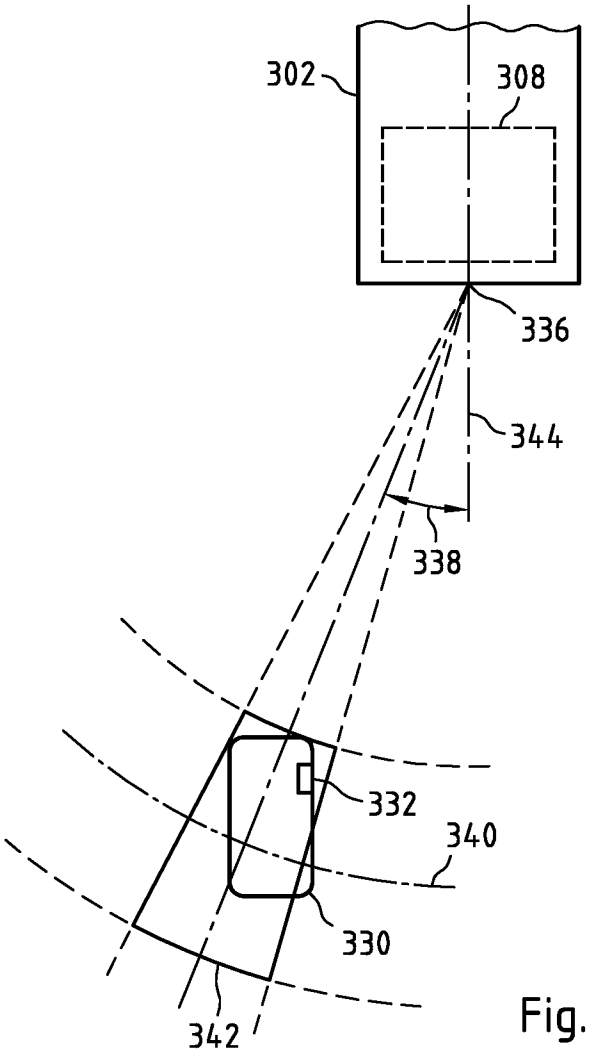

The position determination by the position determination module 224 is described in more detail, by way of example, with reference to FIGS. 3*a* and 3*b*. In the embodiment according to FIG. 3*a*, the position determination is based on the first angular datum and the RSSI (which can be determined in a known manner, for example, by an RSSI module (not shown)) of the information signal received by the gate antennas 210.

By way of example, the position determination is carried out in a polar coordinate system (it shall be understood that a spherical coordinate system may also be provided in practice). By way of example, the origin 336 of the polar coordinate system is the center of the array antenna arrangement 308 (for example, a centrally located gate antenna).

Presently, perpendicular to the front of the gate extends the reference line 344, which lies in a horizontal plane. In particular, the reference line 344 is the polar axis 344 of the polar coordinate system. The position data (e.g., in the form $\{r, \varphi\}$) of the mobile terminal 330 may be formed by the first angular datum 338 and the radius 340 determined from the RSSI.

As shown in FIG. 3*a*, an angular datum range and a radius range may be indicated where measurement tolerances are taken into account in the radius and angle determination. In particular, the position data may therefore indicate the range 342 in which the mobile terminal 330 is currently located.

In the embodiment according to FIG. 3*b*, the position determination is carried out based on the first angular datum 338.1 and a further angular datum 338.2, which was determined by an adjacent array antenna arrangement 308.2. Adjacent means, in particular, that the array antenna arrangement is located at least in the same gate arrangement. Preferably, the array antenna arrangements 308.1, 308.2 are directly adjacent.

The position determination module 224 determines, in particular, the intersection of the first angular datum 338.1 and the further angular datum 338.2, as shown in FIG. 3*b*. To account for measurement tolerances, the respective angular datum range may be used and the intersection range 342 may be determined. Thus, the position data may, in particular, indicate the range 342 in which the mobile terminal 330 is currently located.

In particular, the further angular datum 338.2 may be provided via the receiving device interface 226.

Figure 4:
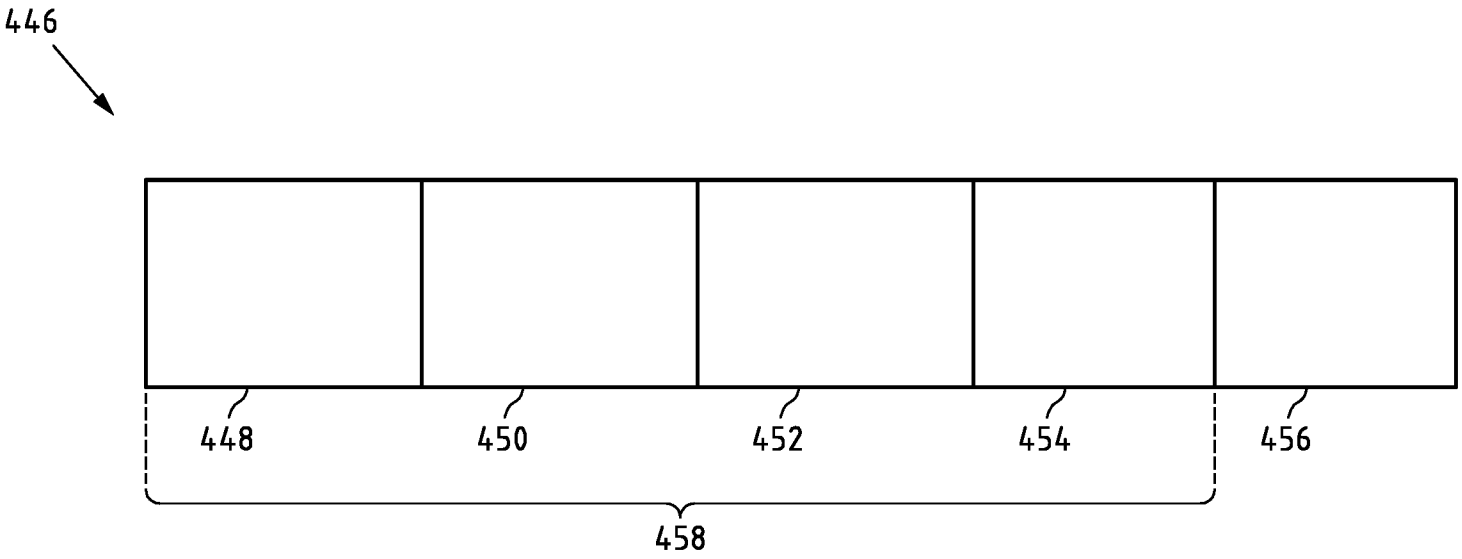

FIG. 4 shows a preferred embodiment of an information signal 446 according to the present application. As described above, the information signal 446 may preferably be a Bluetooth information signal of the version 5.X.

The information signal 446 is formed by a modulated signal part 458 and an unmodulated signal part 456. The modulated signal part 458 contains data content and may contain, by way of example, a preamble 448 (e.g., 1 or 2 octets), an access-address field (e.g., 4 octets), a PDU (payload data unit) (e.g., 2 to 248 octets), and a CRC (cyclic redundancy check) (e.g., 3 octets).

The unmodulated signal part 456 may comprise between 1 to 300 μs of unmodulated signal duration, preferably 16 to 160 μs. In particular, the unmodulated signal part 456 may be a CTE (Constant Tone Extension). In particular, this is not eliminated from the information signal 446 even during a so-called "whitening process".

Figure 5:
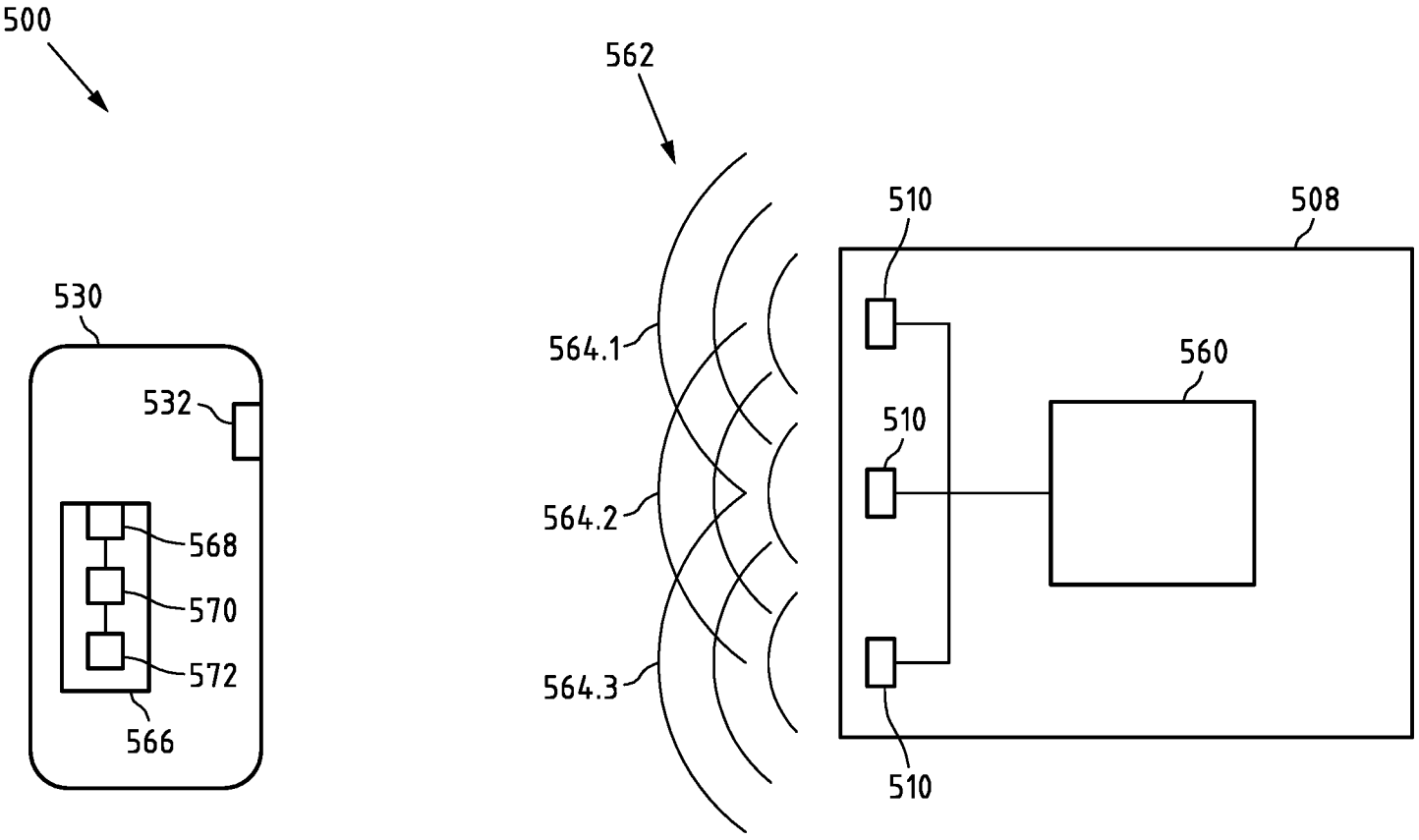

FIG. 5 shows a schematic view of a further embodiment of an access system 500, according to the present application. To avoid repetitions, essentially only the differences to the previous embodiments are described below, and otherwise reference is made to the previous embodiments. It should further be noted that, for the sake of clarity, the gate has been omitted. In particular, the shown embodiment is based on the "Angle of Departure" scheme.

The array antenna arrangement 508 comprises a gate emitting device 560 electrically coupled to the gate antennas 510. In particular, the gate emitting device 560 is configured to control the emission of a first array information signal 562. The array information signal 562 is formed by a plurality of individual information signals 564.1, 564.2, 564.3, each of which is emitted by the gate antennas 510. For example, an individual information signal 564.1, 564.2, 564.3 may be formed as shown in FIG. 4.

For an optimized position determination of a mobile terminal 530 receiving the array information signal 562, the gate emitting device 560 may be configured to control the emission of the first array information signal 562 such that the respective unmodulated signal parts of the individual information signals 564.1, 564.2, 564.3 of the first array information signal each have a specific phase relationship to each other. This may be known to a terminal receiving device 566. In particular, this can be taken into account in the position determination.

As can further be seen, the mobile terminal 530 comprises a terminal receiving device 566, which is formed, in particular, as an access application 566. In particular, the access application 566 is installed as an app on the mobile terminal 530 (for example, a smartphone 530).

Presently, the access application 566 comprises a plurality of software modules 568, 570, 572. For example, an antenna 532 (via further elements, such as filters, A/D converters, amplifiers, etc.) may provide (digital) antenna signals to a receiving module 568. The (digital) antenna signals are based on the received individual information signals 564.1, 564.2, 564.3.

In other words, the receiving module 568 is configured to receive antenna signals based on at least the respective unmodulated signal parts of individual information signals 564.1, 564.2, 564.3 of an array information signal 562 received by an antenna 532 of the mobile terminal 530. As has already been described, the array information signal 562 was emitted by an array antenna arrangement 508 of a gate comprising a plurality of gate antennas 510 arranged adjacent to each other.

At least one position determination module 572 is provided in the access application 566 configured to determine position data of the mobile terminal 530 receiving the array information signal 562. This is done, in particular, based on the unmodulated signal part of the array information signal 562, i.e., the respective unmodulated signal parts of the respective individual information signals 564.1, 564.2, 564.3 of the array information signal 562.

In particular, the access application 566 may comprise a demodulation module 570. The demodulation module 570 may demodulate (in particular, in a manner analogous to the previous embodiments) the antenna signals. In particular, an amplitude datum and a phase datum may be provided for each antenna signal. The data may be provided to the position determination module 572.

The position determination module 572 may determine (in particular, in a manner analogous to the previous embodiments) position data of the mobile terminal 530 based at least on provided amplitude data and phase data of a first array antenna signal 562.

Furthermore, the position determination may be based on an RSSI of the array antenna signal 562. This can be done, in particular, in an analogous manner to the explanations for FIG. 3*a*.

Alternatively or additionally, the position determination module 572 may be configured to determine position data of the mobile terminal 530 based on the demodulated first antenna signals and on demodulated second antenna signals of a further array information signal. The further array information signal may have been emitted by a further array antenna arrangement arranged adjacent to the first array antenna arrangement (which may, in particular, be associated with at least the same gate arrangement).

As has already been described, at least one gate identifier may be contained as data content in the respective individual information signals 564.1, 564.2, 564.3 in the corresponding modulated signal parts. Based on the gate identifier, the position determination module 572 may identify the emitting gate and the corresponding array antenna arrangement, respectively.

After the angular data of two array information signals of different gates (determined by the respective gate identifier) have been determined, the position data of the mobile terminal 530 can be determined by the position determination module 572, in particular, in a manner analogous to the explanations for FIG. 3*b*.

Figure 6:
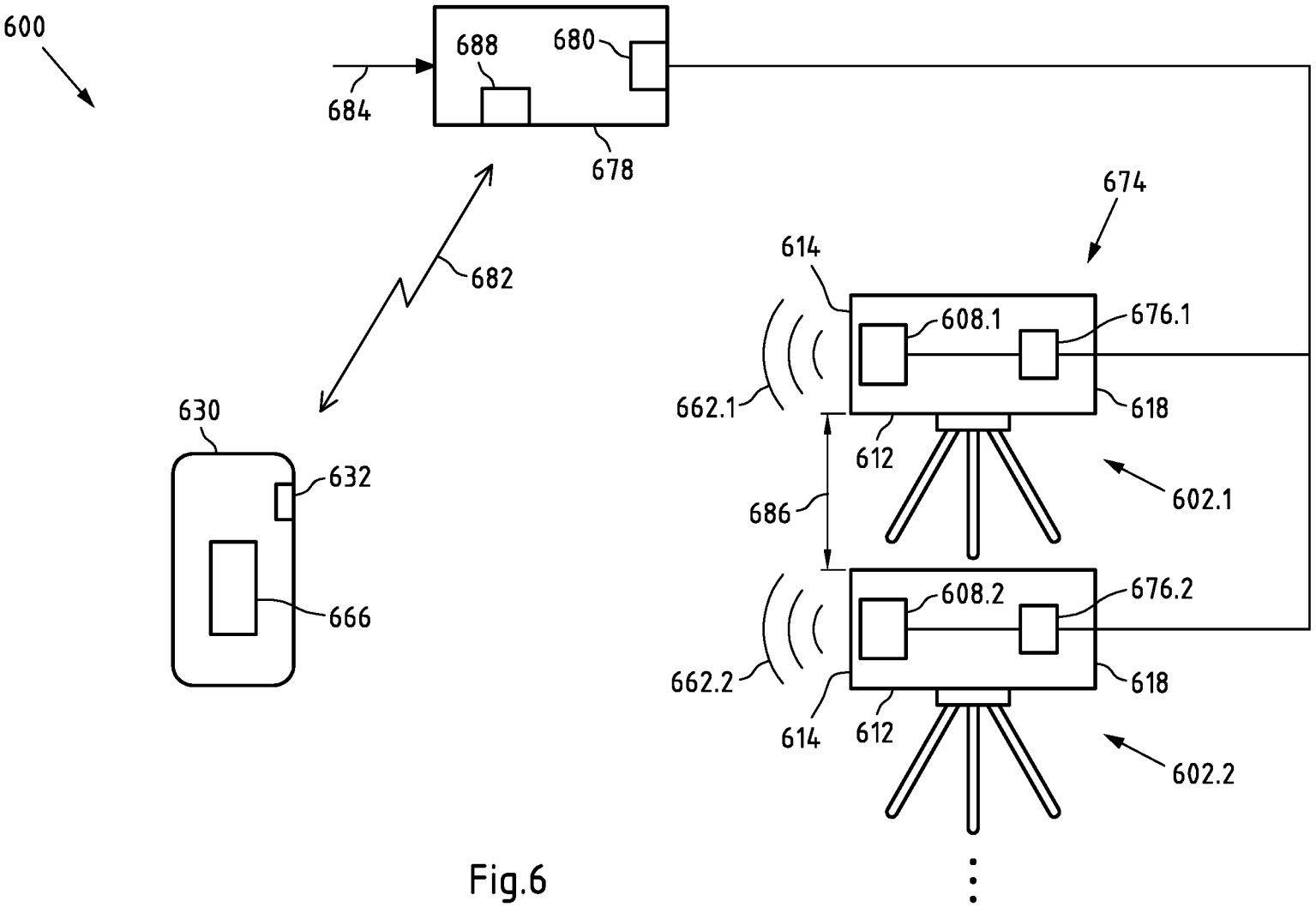

FIG. 6 shows a schematic view of a further embodiment of an access system 600, according to the present application. To avoid repetitions, essentially only the differences to the previous embodiments are described below, and otherwise reference is made to the previous explanations, in particular, to the explanations regarding FIG. 5. In particular, the shown embodiment is based on the "Angle of Departure" scheme.

In the present embodiment, the access system 600 comprises at least one gate arrangement 674 having a first gate 602.1 and at least one further gate 602.2. Preferably, a plurality of further gates may be provided, and/or the access system 600 may comprise a plurality of (remotely located) gate arrangements.

In each gate 602.1, 602.2, the structure of the gate antennas (not shown in detail for the sake of a better overview) can be formed in the same way, in particular, the same array antenna arrangement 608.1, 608.2 can be arranged.

In addition, the gate antennas in each gate 602.1, 602.2 may be arranged at the same position in the gate housing 612. As can be further seen, all of the gates 602.1, 602.2 of the gate arrangement 674 are also arranged in a predetermined manner with respect to each other. In particular, the distance 686 between each directly adjacent gate 602.1, 602.2 is the same.

In particular, this can be the case for each gate arrangement of the access system. Hereby, a simpler setting of the electrical components and/or the position determination algorithm can take place. Therefore, in particular, a simpler installation of a gate arrangement can take place. In particular, the so-called "fine-tuning" at the installation site of the gate arrangement can be carried out with less effort or can even be omitted completely.

As can further be seen, each gate 602.1, 602.2 comprises a local control module 676.1, 676.2. The local control module 676.1, 676.2 is configured to control the respective gate 602.1, 602.2. In particular, the control module 676.1, 676.2 can release or block a passage of the respective gate 602.1, 602.2 for the user (as will be explained in more detail below by way of example). In other variants of the application, a gate arrangement may also comprise only a single control module for controlling all gates of the gate arrangement.

Further, the present access system 600 comprises a backend system 678. The backend system 678 may be formed by one or more servers, for example, remotely located. The backend system 678 comprises at least one communication module 680, 688. The at least one communication module 680, 688 is configured to communicate with a control module 676.1, 676.2 of a gate 602.1, 602.2 and/or with a mobile terminal 630. In case that different transmission technologies are provided, a corresponding number of different communication modules 680, 688 may be provided.

Figure 8:
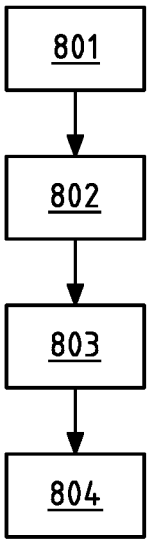

In particular, the mobile terminal 630 comprises an access application 666 described above (for the sake of a better overview, the individual modules have not been shown). The method of operation is explained in more detail below with the aid of FIG. 8. FIG. 8 shows a diagram of an embodiment of a method according to the present application, in particular, for operating and executing, respectively, an access application 666.

During operation of the access system 600, each array antenna arrangement 608.1, 608.2 emits (periodically, nearly continuously) said array information signals 662.1, 662.2.

When a mobile terminal 630 comes within a range of at least one array antenna arrangement 608.1, 608.2, a (Bluetooth) antenna 632 receives the array information signal 662.1, 662.2 (and the respective individual information signals, respectively). The antenna (and other components, such as filters, amplifiers, A/D converters, etc.) may provide the respective antenna signals to an activated access application 666 and terminal receiving device, respectively.

In a step 801, a receiving of said antenna signals, in particular, by at least one receiving module occurs (which can be formed, in particular, as a bidirectional interface). These are based at least on the respective unmodulated signal parts of individual information signals of an array information signal 662.1, 662.2 received by an antenna of the mobile terminal.

In steps 802 and 803, a determining of position data of the mobile terminal 630 receiving the array information signal occurs, based at least on the unmodulated signal parts of the individual information signals.

In particular, in step 802, an I&Q demodulation may be carried out by a demodulation module of the access application 666 in a previously described manner. Subsequently, in step 803, the (current) position data of the mobile terminal 630 may be determined in a previously described manner.

In particular, in step 804, a causing, by the access application 666 (for example, the bidirectional interface or a transmitting module), of a transmission of at least the determined position data occurs. In a preferred example, a data set may be transmitted containing the gate identifier received through the at least one array information signal, at least one authentication datum, such as a user identifier (e.g., a user name, a terminal identifier such as the IMEI, etc.) and/or ticket information. It shall be understood that further data may be included, such as a timestamp.

This data set may be transmitted to the backend system 678 via a communication network 682. The backend system 678 may check the user ID and/or the authentication datum. If the user is authorized to pass through the gate 602.1, 602.2 mentioned in the data set, the backend system 678 may forward at least the position data of the mobile terminal 630 to a control module 676.1, 676.2 (based on the gate identifier). The additional sensor data, such as camera data, RF sensor data, etc. possibly received via a further input 684 of the backend system 678 may optionally be added to the position data. In addition, a release datum (and/or user identifier) may be transmitted indicating that the user is authorized to pass.

As has already been described, steps 801 to 804 may preferably be carried out periodically, almost continuously, to obtain a movement profile of the mobile terminal 630. Through this, the correct gate 676.1, 676.2 can be released for the corresponding user at the correct time in a reliable manner (not too early, so that an unauthorized person could pass the gate 676.1, 676.2; and also not too late, so that there is no delay in the user movement). This is made possible by the very precise position determination of the user, according to the application.

It shall be further understood that, alternatively or additionally, a gate 676.1, 676.2 may comprise an interface device (a reader) to detect an authentication datum, for example, in the form of a readable access code, and to initiate verification (e.g., magnetic stripe code, bar code, QR code, RFID identifier, another readable user identifier or mobile terminal identifier, etc.).

Figure 7:
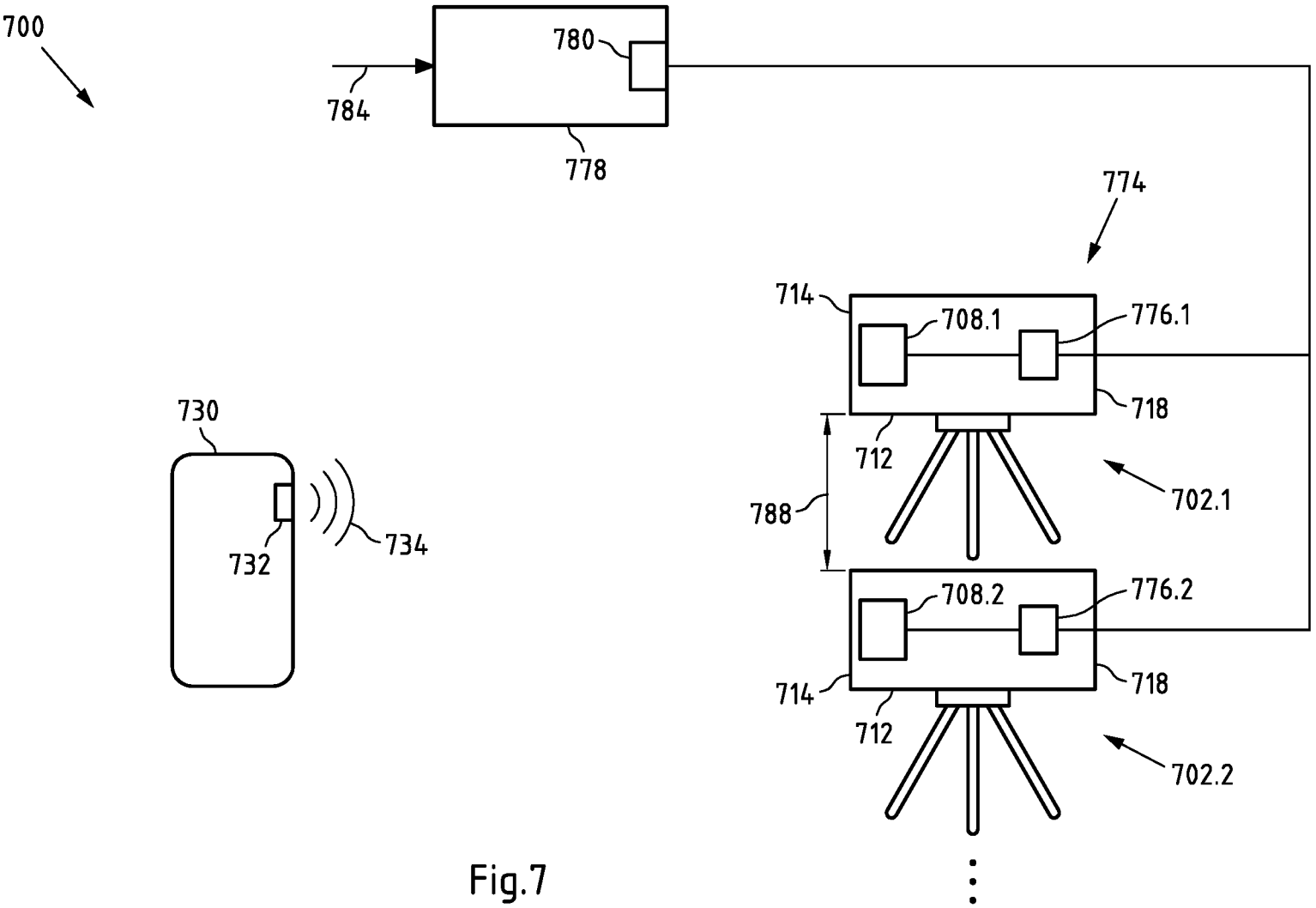

FIG. 7 shows a schematic view of a further embodiment of an access system 700, according to the present application. To avoid repetitions, essentially only the differences to the previous embodiments are described below, and otherwise reference is made to the previous explanations, in particular, to the explanations of FIGS. 2 and 6. In particular, the shown embodiment is based on the "Angle of Arrival" scheme.

Compared to the embodiment of FIG. 6, the gates in the present case comprise array antenna arrangements 708.1, 708.2, each of which comprises a gate receiving device. The mobile terminal 730 comprises an (activated) access application that causes an information signal to be emitted. For example, the access application may have been awakened, i.e., activated, by a receiving of a first beacon signal. The same signal or a further beacon signal may cause the access application to cause a (periodic, nearly continuous) emission of the information signal 734.

Figure 9:
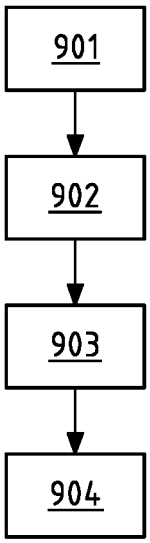

The method of operation is explained in more detail below with the aid of FIG. 9. FIG. 9 shows a diagram of an embodiment of a method according to the present application, in particular, for operating a gate 702.1, 702.2.

As has already been described, an activated access application of a mobile terminal 730 may cause that an information signal 734 is emitted (periodically, almost continuously). The information signal 734 may contain as data content in its modulated signal part at least one authentication datum, such as a user identifier (e.g., a user name, a terminal identifier, such as the IMEI, etc.) and/or a ticket information.

In a step 901, a receiving, by the gate antennas of at least one array antenna arrangement 708.1, 708.2 of a gate 702.1, 702.2, of the information signal 734 takes place. In addition to said modulated signal part, the information signal 734 contains at least one unmodulated signal part.

In step 902, a providing, by the gate antennas, of the antenna signals each based on the unmodulated signal part of the information signal takes place, as described earlier.

Subsequently, in step 903, a determining of the position data of the mobile terminal 730 emitting the information signal 734 takes place, at least based on the unmodulated signal part of the information signal 734. As has already been described, in particular, at first a demodulation and then a position determination can be performed.

The determined position data may be provided to a control module 776.1, 776.2 in step 904. Additionally, the data content of the information signal 734 may be provided to the control module 776.1, 776.2. For example, a check of the authorization of a user to pass through the gate 702.1, 702.2 may be performed based on the at least one authentication datum.

For the verification, a communication can occur with the backend system 778, which can, in particular, perform a data comparison between the authentication datum and stored user data. The additional sensor data possibly received via a further input 784, such as camera data etc., can optionally be provided to the control module 776.1, 776.2.

The control module 776.1, 776.2 may release a passage through the gate 702.1, 702.2 based on the position data (and possibly further sensor data) and, for example, the verification result. In particular, a release may only occur if the verification of the authentication datum indicates that the user is authorized to pass through the gate 702.1, 702.2 and the position data indicated that the user actually wants to pass through the gate 702.1, 702.2. Otherwise, the gate 702.1, 702.2 may remain blocked.

As has already been described, the steps 901 to 904 can preferably be performed periodically, almost continuously, to obtain a movement profile of the mobile terminal 730. Through this, the correct gate 702.1, 702.2 can be released for the user at the correct time in a reliable manner (not too early, so that an unauthorized person could pass the gate; and also not too late, so that there is no delay in the movement of the user). This is made possible by the very precise position determination of the user, according to the application.

It shall be further understood that, alternatively or additionally, a gate 702.1, 702.2 may comprise interface means (a reader) to detect an authentication datum, for example, in the form of a readable access code, and to initiate verification (e.g., magnetic stripe code, bar code, QR code, RFID identifier, other readable user identifier or mobile terminal identifier, etc.).

What is claimed is:

1. Access system for a transit system, comprising:

a gate arrangement comprising a first gate and at least one further gate, wherein the first gate and the further gate are configured to enable an access from a first area to a second area, wherein the first gate comprises at least one first array antenna arrangement configured to process at least one information signal containing at least one modulated signal part and at least one unmodulated signal part, wherein the further gate comprises at least one further array antenna arrangement configured to process the at least one information signal, wherein the first array antenna arrangement comprises a plurality of gate antennas arranged adjacent to each other, wherein the further array antenna arrangement comprises a plurality of gate antennas arranged adjacent to each other, wherein the processing of the at least one information signal comprises continuous determination of the position data of a mobile terminal in relation to the first gate and the further gate based on an evaluation of the unmodulated part of the at least one information signal for determining a current movement profile of the mobile terminal thereby identifying the gate of the first gate and further gate towards which a user of the mobile terminal is heading, and a control module configured to enable a passage through the first gate or the further gate for the user of the mobile terminal at least based on the determined position data of the mobile terminal, wherein the identified gate is released when the user actually reaches the identified gate.

2. Access system according to claim 1, wherein the first array antenna arrangement and/or the further gate array antenna arrangement comprises at least one gate receiving device coupled to the plurality of gate antennas, and the gate receiving device is configured to determine the position data of the mobile terminal emitting the information signal at least based on the unmodulated signal part of a received information signal.

3. Access system according to claim 2, wherein each of the gate antennas is configured to provide an antenna signal based on the unmodulated signal part of the received information signal, and the gate receiving device comprises at least one demodulation module configured to demodulate the provided antenna signals.

4. Access system according to claim 3, wherein the demodulation module is configured to demodulate the provided antenna signals such that for each of the antenna signals an amplitude datum and a phase datum of the unmodulated signal part is determined.

5. Access system according to claim 4, wherein the gate receiving device comprises at least one position determination module configured to determine a first angular datum based on the determined amplitude data and the determined phase data of the antenna signals, and the position determination module is configured to at least partially determine the position data based at least on the determined first angular datum.

6. Access system according to claim 5, wherein the position determination module is configured to determine the position data based on the determined first angular datum and RSSI of the information signal received by the gate antennas.

7. Access system according to claim 5, wherein the gate receiving device comprises at least one receiving device interface configured to obtain at least one further angular datum determined for the received information signal, wherein the further angular datum is provided by the further array antenna arrangement arranged adjacent to the first array antenna arrangement, and the position determination module is configured to determine the position data based on the determined first angular datum and the provided further angular datum.

8. Access system according to claim 2, wherein the further array antenna arrangement comprises at least one gate receiving device coupled to the further gate antennas.

9. Access system according to claim 1, wherein the first array antenna arrangement and/or the further gate array antenna arrangement comprises at least one gate emitting device coupled to the gate antennas configured to control an emission of a first array information signal by the gate antennas, wherein the first array information signal contains a plurality of individual information signals respectively emitted by the gate antennas.

10. Access system according to claim 9, wherein the gate emitting device is configured to control the emission of the first array information signal such that the unmodulated signal part of each of the individual information signals of the first array information signal each have a specific phase relationship to each other.

11. Access system according to claim 9, wherein the access system comprises at least one terminal receiving device disposed in a mobile terminal and coupled to an antenna of the mobile terminal, wherein the terminal receiving device comprises at least one demodulation module configured to demodulate first antenna signals resulting from the first array information signal received by the antenna of the mobile terminal.

12. Access system according to claim 11, wherein the terminal receiving device comprises at least one position determination module configured to determine the position data of the mobile terminal based on the demodulated first antenna signals, in particular, phase datum determined for each first antenna signal and amplitude datum determined for each first antenna signal.

13. Access system according to claim 12, wherein the position determination module is configured to determine the position data of the mobile terminal based on the demodulated first antenna signals and on RSSI of the first information signal received by the antenna of the mobile terminal, and/or the position determination module is configured to determine the position data of the mobile terminal based on the demodulated first antenna signals and on demodulated second antenna signals of a further array information signal emitted by a further array antenna arrangement arranged adjacent to the first array antenna arrangement.

14. Access system according to claim 1, wherein the first gate comprises a front side and a back side, wherein the front side faces a passage direction, and at least the plurality of gate antennas of an array antenna arrangement is arranged on the front side, in particular, directly behind a front panel of a gate housing forming the front side.

15. Access system according to claim 1, wherein the control module is configured to control access through the gate, additionally based on at least one of the data from the group comprising:

an authentication datum associated with the mobile terminal, a camera datum, a near-field sensor datum, a far-field sensor datum.

16. Access system according to claim 1, further comprising a backend system including at least one communication module configured to communicate with the control module and/or with a mobile terminal, and the communication module is, in particular, configured to transmit to the control module at least one of the data from the group comprising:

position data of the mobile terminal, an authentication datum associated with the mobile terminal, a camera datum, a near-field sensor datum, a far-field sensor datum.

17. A method of operating an access system with gate arrangement comprising a first gate and at least one further gate, each of the first and further gate comprising an array antenna arrangement comprising a plurality of gate antennas disposed adjacent to each other and a receiving device coupled to the gate antennas, the method comprising:

receiving, by the gate antennas, an information signal containing at least one modulated signal part and at least one unmodulated signal part, providing, by the gate antennas, antenna signals each based on the unmodulated signal part of the received information signal, and determining position data of a mobile terminal emitting the information signal at least based on the provided antenna signals, wherein the determining comprises a continuous determination of the position data of the mobile terminal in relation to the first gate and the further gate based on an evaluation of the unmodulated part of the at least one information signal for determining a current movement profile of the mobile terminal thereby identifying the gate of the first gate and further gate towards which a user of the mobile terminal is heading, and enabling, by a control module, a passage through the first gate or the further gate for a the user of the mobile terminal at least based on the determined position data of the mobile terminal, wherein the identified gate is released when the user actually reaches the identified gate.

18. A tangible non-transitory computer readable storage medium encoded with instructions that, when executed by a processor of a mobile terminal establishes computer processes for interacting with an access system, the computer processes comprising:

receiving antenna signals based on at least respective unmodulated signal parts of individual information signals of an array information signal received by an antenna of the mobile terminal, wherein the array information signal was emitted by an array antenna arrangements with a plurality of gate antennas arranged adjacent to each other of a first gate and a further gate of a gate arrangement, and determining position data of the mobile terminal receiving the array information signal based at least on the unmodulated signal part of the individual information signals of the array information signal, wherein the determining comprises a continuous determination of the position data of the mobile terminal in relation to the first gate and the further gate based on an evaluation of the unmodulated part of the at least one information signal for determining a current movement profile of the mobile terminal thereby identifying the gate of the first gate and further gate towards which a user of the mobile terminal is heading.

19. A method of operating an access application, implemented on a mobile terminal, comprising:

receiving antenna signals based on at least respective unmodulated signal parts of individual information signals of an array information signal received by an antenna of the mobile terminal, wherein the array information signal was emitted by an array antenna arrangement with a plurality of gate antennas arranged adjacent to each other of a first gate and a further gate of a gate arrangement, and determining position data of the mobile terminal receiving the array information signal based at least on the unmodulated signal part of the individual information signals of the array information signal, wherein the determining comprises a continuous determination of the position data of the mobile terminal in relation to the first gate and the further gate based on an evaluation of the unmodulated part of the at least one information signal for determining a current movement profile of the mobile terminal thereby identifying the gate of the first gate and further gate towards which a user of the mobile terminal is heading.

20. A mobile terminal comprising the computer readable storage medium according to claim 18 installed on the mobile terminal.

* * * * *